US005490614A

United States Patent [19]

Sardynski

[11] Patent Number: 5,490,614

[45] Date of Patent: Feb. 13, 1996

[54] BEVERAGE DISPENSER TRAY ASSEMBLY

[75] Inventor: Gary F. Sardynski, Medford, Mass.

[73] Assignee: Jet Spray Corp., Norwood, Mass.

[21] Appl. No.: 151,069

[22] Filed: Nov. 10, 1993

[51] Int. Cl.[6] ..... B67D 5/56

[52] U.S. Cl. ..... 222/129.1; 222/66; 222/132; 222/146.6

[58] Field of Search ..... 222/129.1–129.4, 222/66, 146.6, 132

[56] References Cited

U.S. PATENT DOCUMENTS

| | | | |
|---|---|---|---|
| Re. 33,943 | 6/1992 | Arzberger et al. . | |
| 4,610,145 | 9/1986 | Arzberger et al. | 222/146.6 X |
| 4,645,095 | 2/1987 | Coppola . | |
| 4,717,045 | 1/1988 | Coppola . | |
| 4,728,005 | 3/1988 | Jacobs . | |
| 4,732,297 | 3/1988 | Schroeder, Jr. . | |
| 4,795,061 | 1/1989 | Peckjian | 222/66 |
| 4,856,676 | 8/1989 | Emody | 222/66 |
| 5,303,846 | 4/1994 | Shannon | 222/66 X |

FOREIGN PATENT DOCUMENTS 1244907 11/1988 Canada .

*Primary Examiner*—Gregory L. Huson
*Attorney, Agent, or Firm*—Wolf, Greenfield & Sacks

[57] ABSTRACT

A beverage dispenser has a tray assembly for holding at least three containers, each having a plurality of electrodes. An electrical system provides a voltage to one electrode in each container, and detects when the syrup is below a certain level. The tray assembly has a first tray for supporting a first container and a second tray for supporting a second container, where the first and second trays are electrically insulated from each other. Each tray is coupled to a lead which carries a signal, and each tray is coupled to an electrode of the respective container. The first tray includes a vertical member which contacts an electrode of the second containers. The tray assembly can accommodate three or more containers and uses signals through the electrodes and leads to provide an out-of-strup indication separately for each container.

20 Claims, 9 Drawing Sheets

BEVERAGE DISPENSER TRAY ASSEMBLY

FIELD OF THE INVENTION

This invention relates to a beverage dispenser, and more particularly to a dispenser for combining water and a concentrated syrup to produce a drink.

Background of the Invention

In typical juice dispensers, concentrated juice is provided as a syrup in a plastic container or in a bag-in-box container which is kept in a refrigerated compartment. The syrup is pumped from the container in the refrigerated compartment to a mixing valve. The mixing valve also receives cool water which is combined with the syrup to provide a cool drink.

In most beverage dispensers, such as the dispenser shown and described in Reissue patent U.S. Pat. No. 33,943, which is assigned to the same assignee as the present invention, and which is hereby incorporated by reference, there are typically one or two containers of juice. The dispenser may have an out-of-syrup sensor which provides a visual indication to the user when the concentrated syrup in the container fall below a certain level. Electrodes on-the side of the containers are "hot" and the horizontal base has a grounded vertical extension which extends upward between the containers. This tray system and electrode arrangement does not work, however, when there are more than two concentrated juice containers.

Syrup in the container is pumped from the container to the mixing valve. When syrup is not drawn from a container for an extended period of time, the syrup in the pump can become warm. As a result, the next beverage which is dispensed may be unacceptably warm to the drinker.

When the container runs out, a new container is provided, or a funnel is used in the top of the dispenser to refill the container. In the top-fill system of the reissue patent, a rubber gasket is provided between the funnel and the metal housing of the dispenser. This gasket can get syrup on it and require cleaning. It would be desirable to have a funnel system which is easier to clean and maintain.

Typical dispensers have a splash plate for protecting controls on the inside of the cabinet in case a juice splashes. This can occur, for example, if a glass is not properly positioned beneath the spout and the juice splashes from a tray on which a glass normally rests. When using microprocessor controls, diagnostic tests can be performed, and the circuit board may have lights or indicators which show the results of the diagnostic tests. Consequently, it is desirable to operate the dispenser while being able to observe the circuit board, and would be desirable to protect the circuit board while being able to observe it when the dispenser is dispensing.

Summary of the Invention

A beverage dispenser is provided which has a tray system and out of syrup sensor for use with three or more containers, an improved filling apparatus, a refrigerated pump, and an improved structure for observing operation of the dispenser. A tray assembly according to the present invention can support three or more containers. At least one portion of the tray assembly is a horizontal piece underneath a container which is intermediate to end containers. This piece is electrically insulated from at least one other horizontal portion which supports a container. An electrical path extends from this horizontal piece, through syrup in the container, and to an electrode in the side of the container.

In another aspect of the present invention, the beverage dispenser has a pump which is driven by a motor. The pump is in fluid communication with the container and draws syrup from the container to a mixing valve where the syrup is combined with water. The refrigerated compartment encloses the container, the pump, and conduits for providing the syrup from the container to the pump. With this arrangement, syrup which is left in the pump after dispensing a previous drink will remain cool because it remains within the refrigerated compartment. Accordingly, after an extended gap in time, the next drink will still be cool.

In another aspect of the present invention, a plastic shield is provided behind the splash guard so that when the splash guard is removed, a user can observe the circuit board while still operating the dispenser. The shield reduces the possibility that liquid will contaminate the circuit board. The shield is preferably a clear plastic which is vertically mounted and supported at its vertical top. This enables the bottom of the shield to be lifted to gain easy access to the circuit board.

In yet another aspect of the present invention, the beverage dispenser has funnels which have an interference fit with the container and do not require any gaskets. As a result, these funnels are easier to clean and maintain. The lid over the funnels has a removable plastic portion which can be easily cleaned.

BRIEF DESCRIPTION OF THE DRAWINGS

Other features and advantages will become apparent from the following detailed description and from the claims when read in conjunction with the following figures in which:

DETAILED DESCRIPTION

Figure 2:
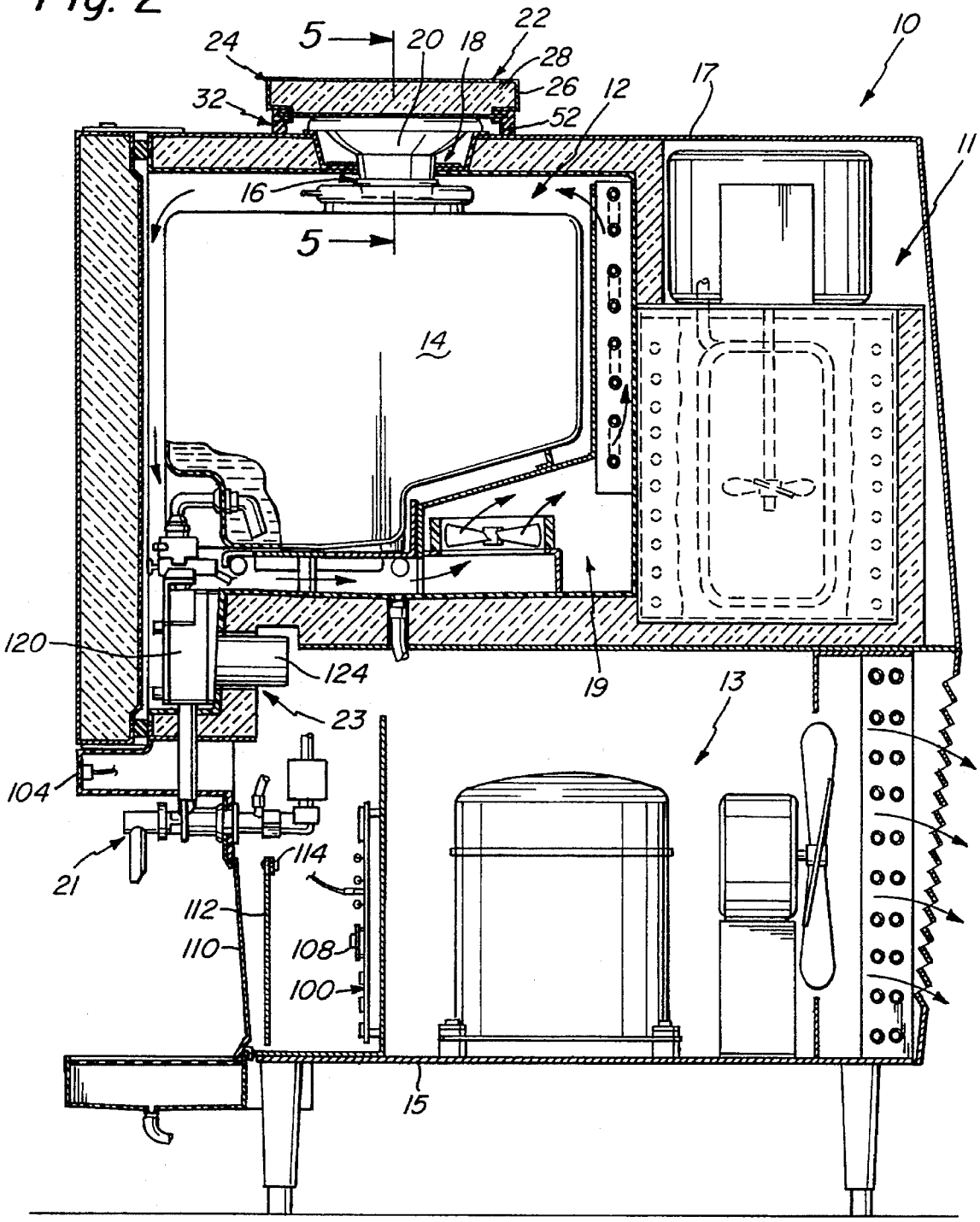
FIG. 2 is a cross-sectional side view taken along line 2—2 of FIG. 1.

The present invention relates to a beverage dispenser which combines a concentrated syrup with fresh water to provide a cool drink. Referring to FIG. 2, the beverage dispenser 10 has a refrigerated compartment 12 for holding a container 14 with the syrup, a refrigerated mechanism 11 for cooling the water which is provided from an external line (not shown) to the dispenser, and a refrigeration system 13 mounted on the base 15 of cabinet 17. Compartment 12 has a cooling system 19 with coils and a fan for circulating cool air within compartment 12. The cool water and the syrup are provided to mixing valve 21 from pump assemblies 23. Controls allow the user then to dispense the beverage from the mixing valves through a spout. The beverage dispenser is controlled by microprocessor controls on a circuit board 100 in the interior of the dispenser.

The top fill arrangement is illustrated and described in connection with FIGS. 1, 2, 3, 5, and 6. Compartment 12 can hold two, three, or more containers 14, as desired. Each container 14 has an opening in the top which is aligned under an opening 18 in the refrigerated compartment. A plastic funnel 20 is provided in each opening 18 and extends into opening 16 in each container 14.

Figure 6:
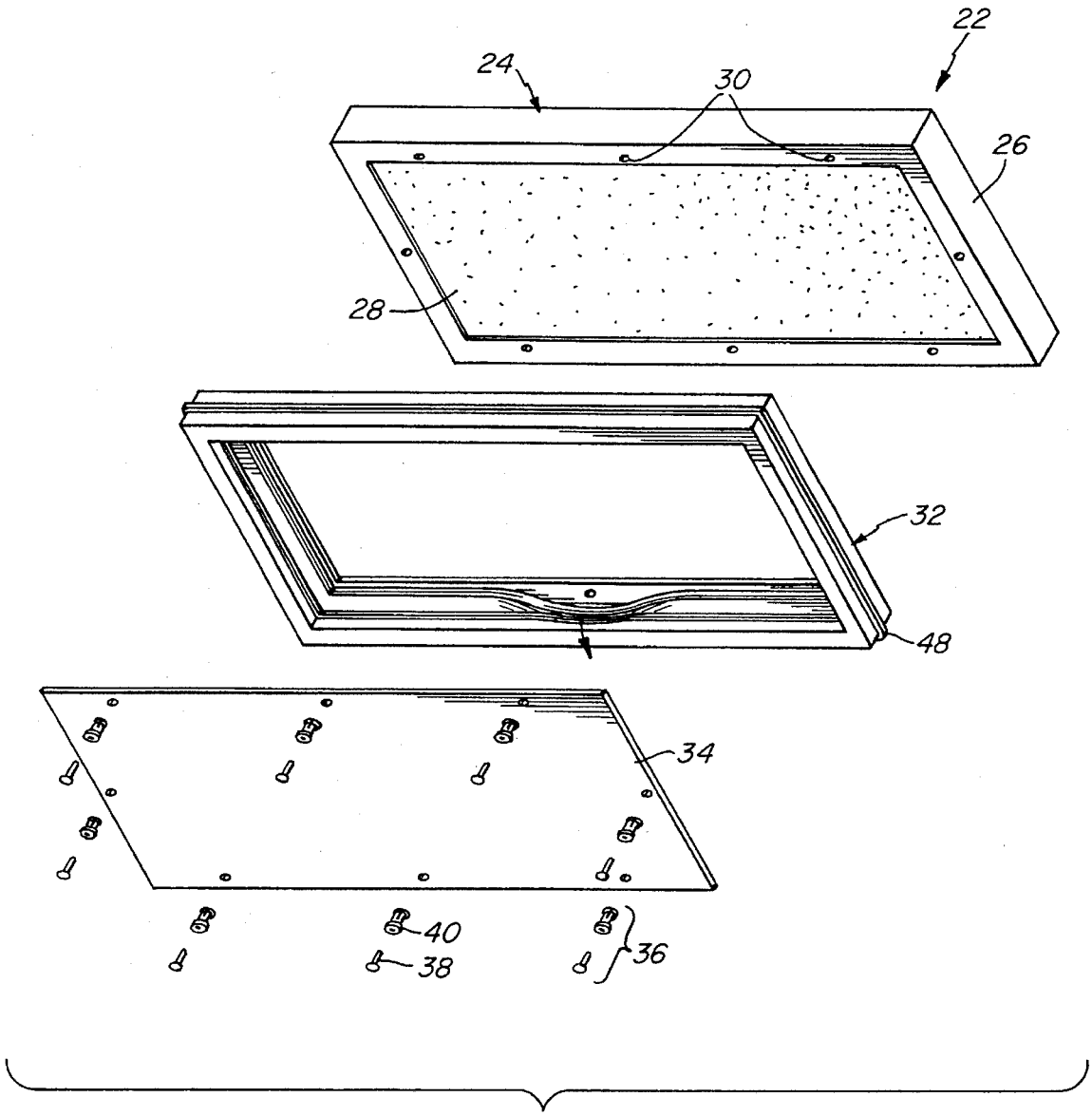
FIG. 6 is an exploded bottom perspective view of a top fill cover assembly.

Funnels 20 are covered by a cover 22 which is shown in more detail in an exploded view in FIG. 6. Cover 22 has a top panel 24 which has a metal skin 26 and insulation 28. Around the perimeter of the metal skin are rivet holes 30. Rubber seal 32 is positioned over the metal skin, and a plastic panel 34 is pressed inside the interior of the seal 32. The plastic panel, seal, and metal skin are held together with plastic snaps 36, each of which includes a center pin 38 and a split leg engaging mechanism 40. Lid 22 is held onto the top surface of the dispenser housing with a magnetic strip 50, at the end of bellows 48. The plastic panel can be removed for cleaning if desired.

Figure 5:
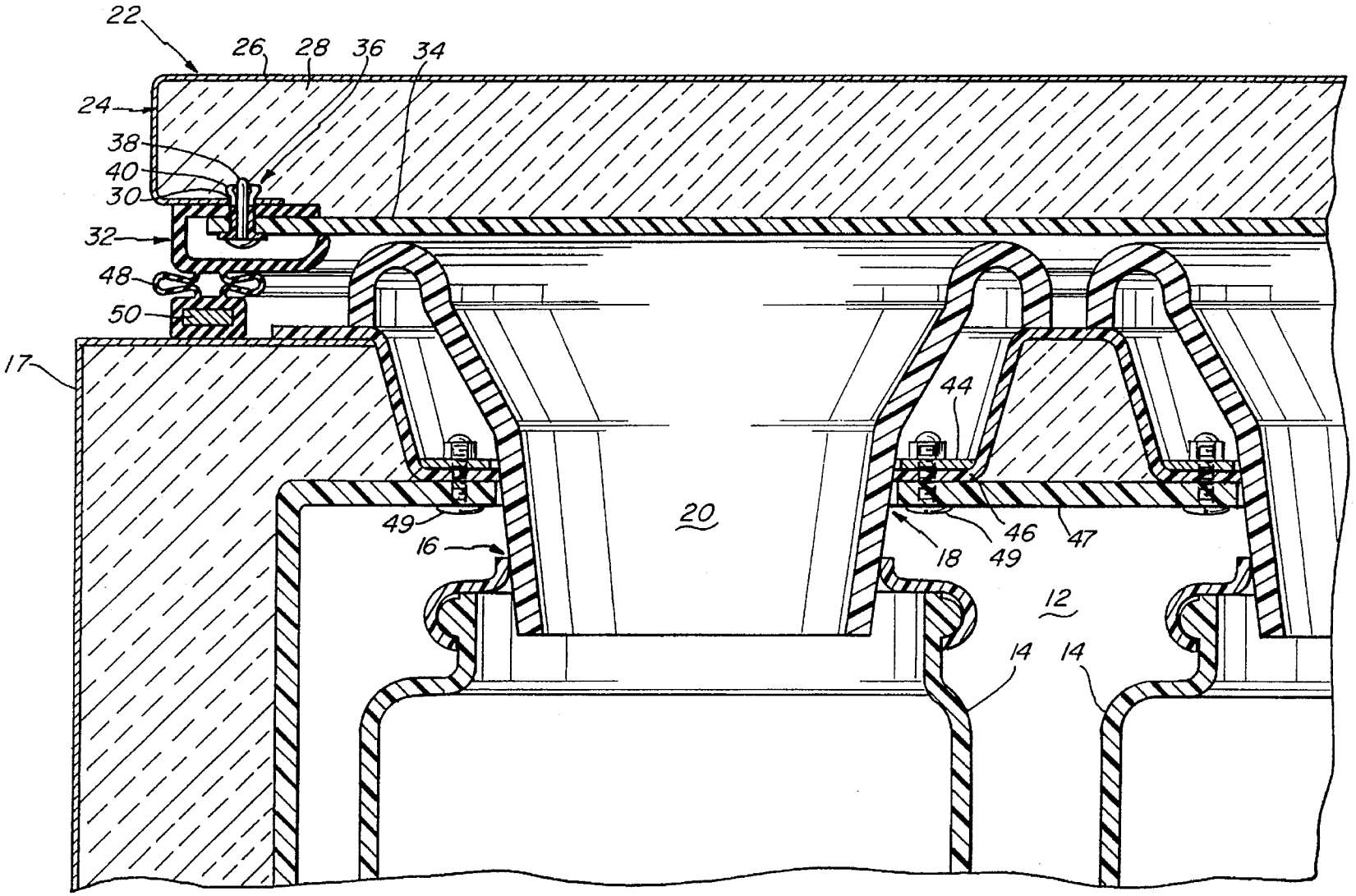
FIG. 5 is a partial cross-sectional front view taken along line 5—5 of FIG. 2.

Referring to FIG. 5 in particular, funnel 20 passes through cabinet 17 and into refrigerated compartment 12. The funnel is surrounded by layers including a metal ring 44, a plastic sleeve 46, and a plastic inner housing wall 47. This three layer assembly is held together with screws 49. No rubber gasket is provided, so the funnels and top openings are easier to clean. The screws are positioned in a recessed portion in the cabinet and do not protrude outside the cabinet at the top surface.

Referring to FIGS. 7–10, a syrup sensing system is provided for a dispenser which may have three or more syrup containers 14 in the refrigerator compartment simultaneously. Electrodes 60*a*–60*f* and the circuitry coupled to the electrodes for sensing the out-of-syrup condition are generally similar to the electrodes shown and described in the incorporated reissue patent.

Figure 7:
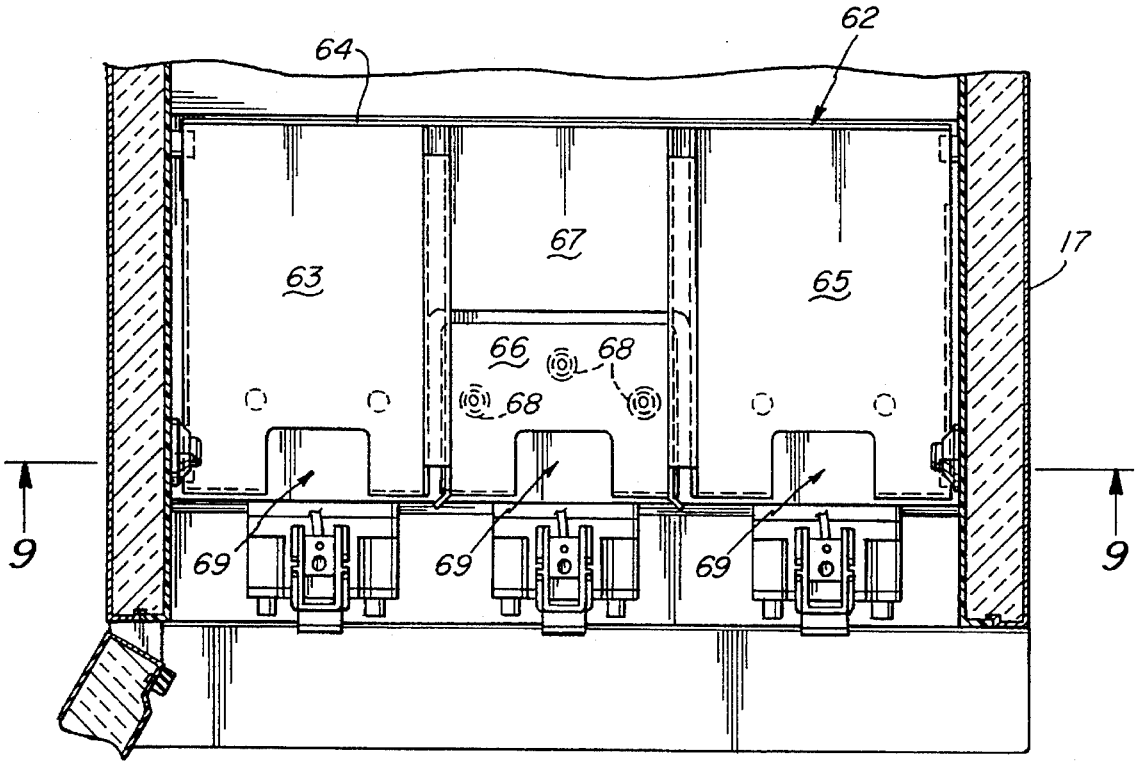
FIG. 7 is a partial cross-sectional top plan view taken along line 7—7 of FIG. 3.
Figure 8:
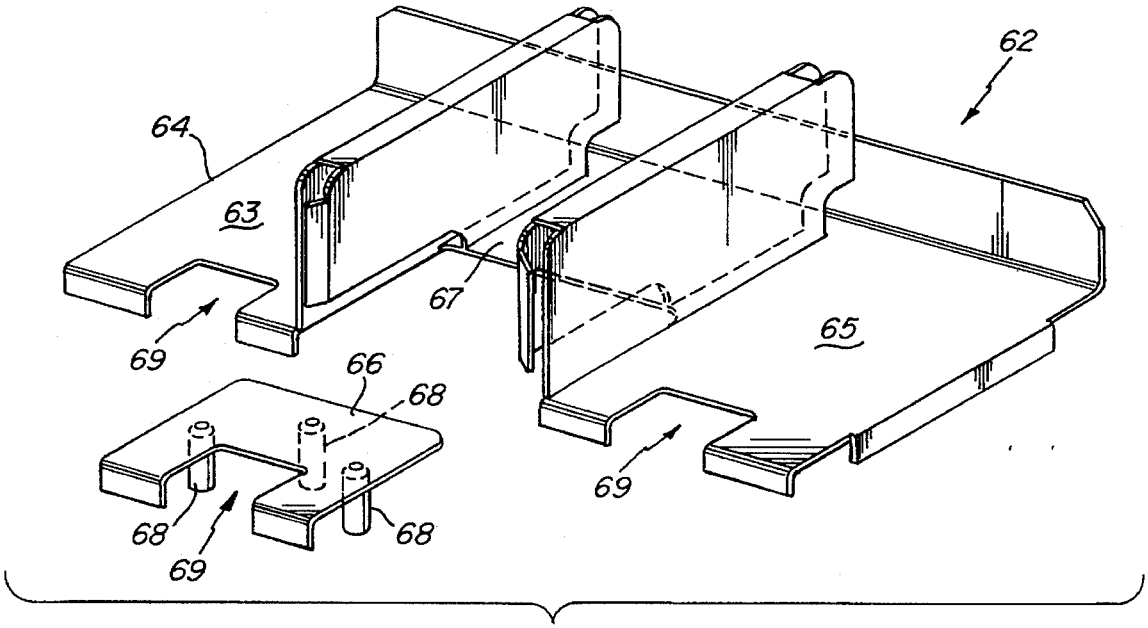
FIG. 8 is an exploded perspective view of the tray assembly.

Referring in particular to FIGS. 7 and 8, tray assembly 62 has two trays 64, 66, which are electrically insulated from each other. In an embodiment in which three containers are used, tray 64 has horizontal support portions 63, 65 for the containers on each end, and a support portion 67 for the center container. Support portion 67 is about half the size of support portions 63 and 65. Tray 64 surrounds smaller tray 66 on three sides. Tray 66 is supported by posts 68 which have electrical contacts. Trays 64, 66 each have rectangular cut-out sections 69 for receiving the mixing and dispensing valves.

Figure 9:
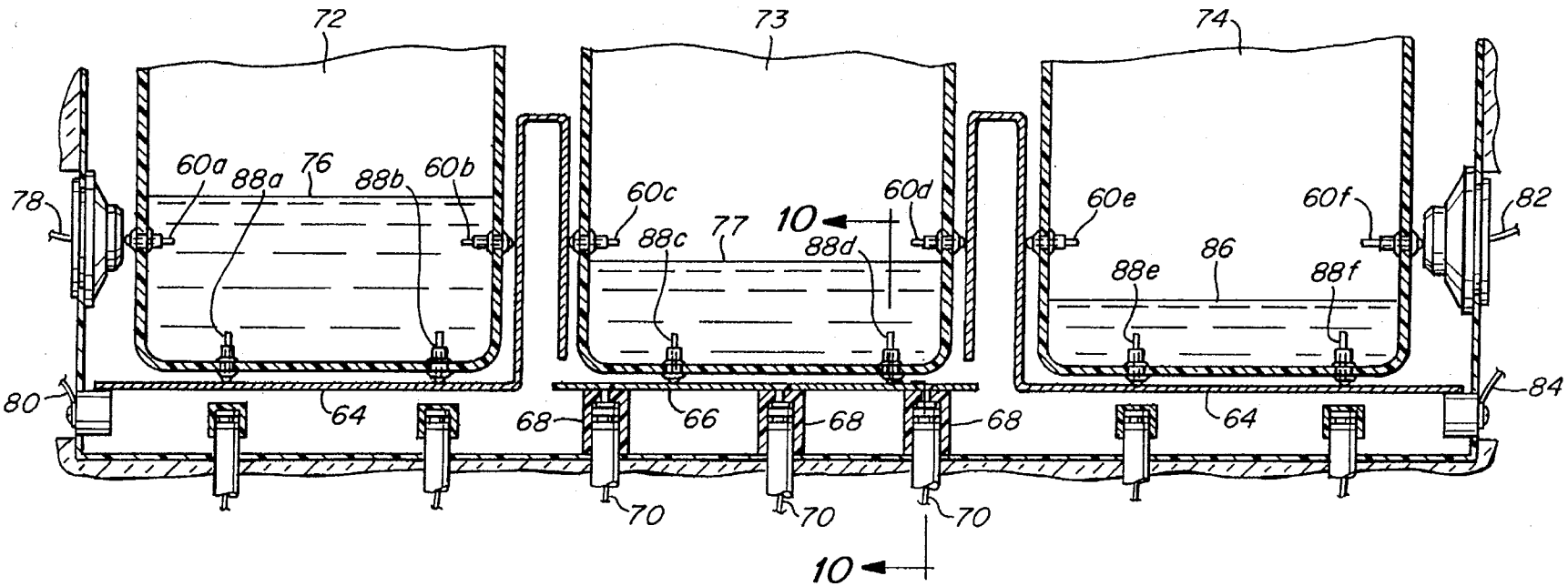
FIG. 9 is a cross-sectional view taken along line 9—9 of FIG. 7.
Figure 10:
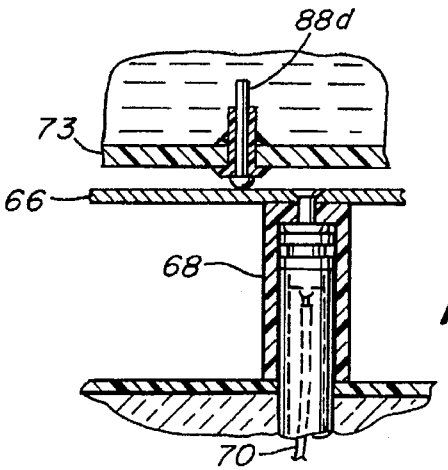
FIG. 10 is a cross-sectional view taken along line 10—10 of FIG. 9.

Referring in particular to FIG. 9, each container 72, 73, 74 has two of electrodes 60*a*–60*f* at the same height on opposite sides, and two of electrodes 88*a*–88*f* at the base of the containers. For end container 72, a voltage is provided from lead 78 through electrode 60*a* and to electrodes 88*a* and 88*b*. These electrodes are coupled to grounded lead 80 through tray 64. Since the level of syrup 76 is above the height of electrodes 60*a* and 60*b*, a noninfinite impedance is detected, which indicates that there is no out-of-syrup condition. With respect to container 74, however, the conductive path to lead 82 from lead 84 is broken when the level of syrup 86 falls below the level of electrodes 60*e*–60*f*. Consequently, circuitry (not shown) indicates that an out-of-syrup condition exists, and a visible indication (not shown), such as a flashing light, is provided on the housing to notify a user. The user can then add syrup through the funnels.

The current flows along a different conductive path in container 73. Leads 70 provide a voltage to tray 66, and, in turn, to electrodes 88*c* and 88*d*. The conductive path extends through syrup 77 to electrodes 60*c* and 60*d*. If, as is true for the center container 73, the syrup is below the vertical level of electrodes 60*c* and 60*d*, the infinite impedance causes circuits (not shown) to indicate the out-of-syrup condition to a user, as described above.

Figure 1:
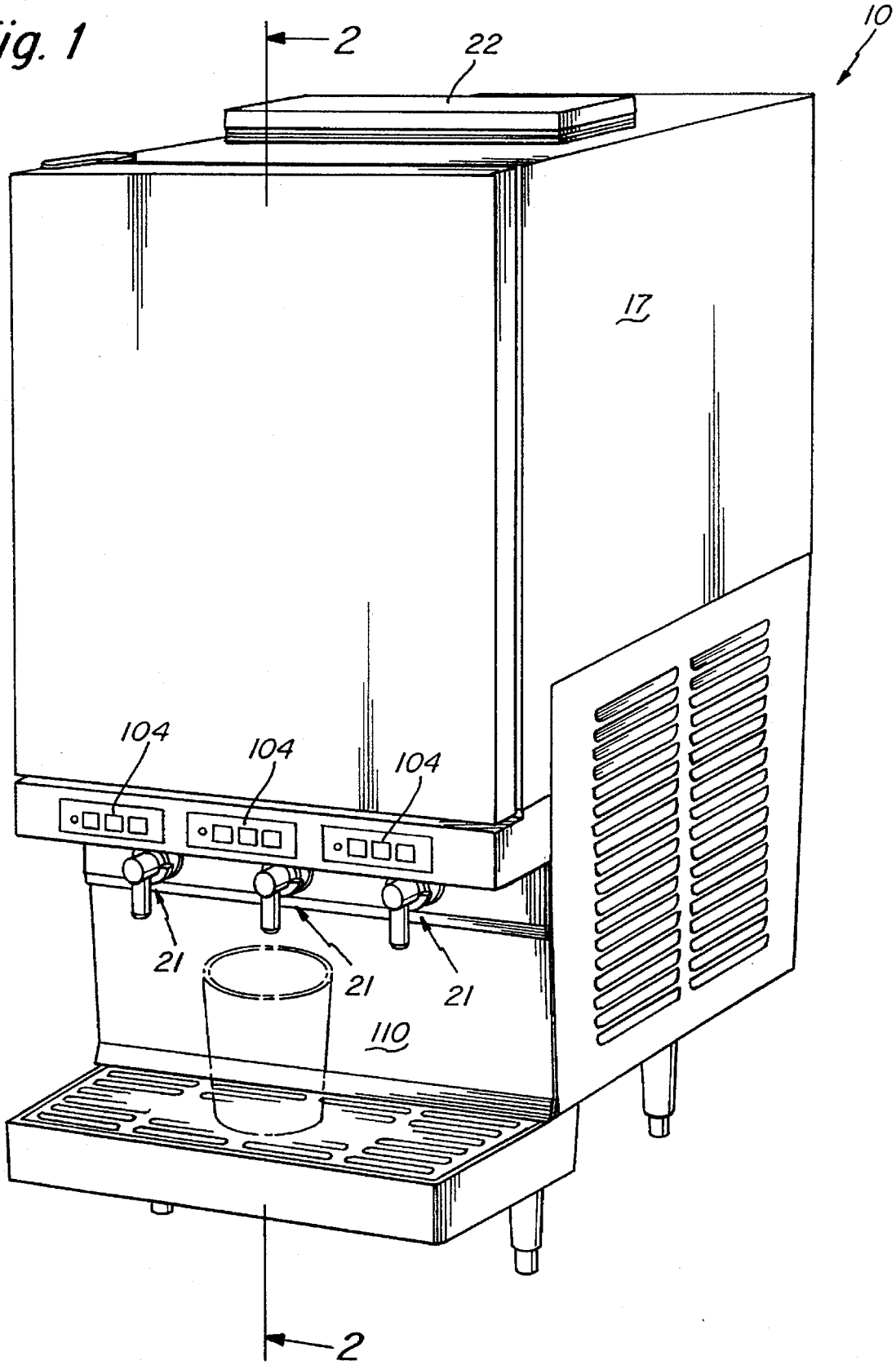
FIG. 1 is a perspective of a dispenser which can dispense three different juices.
Figure 3:
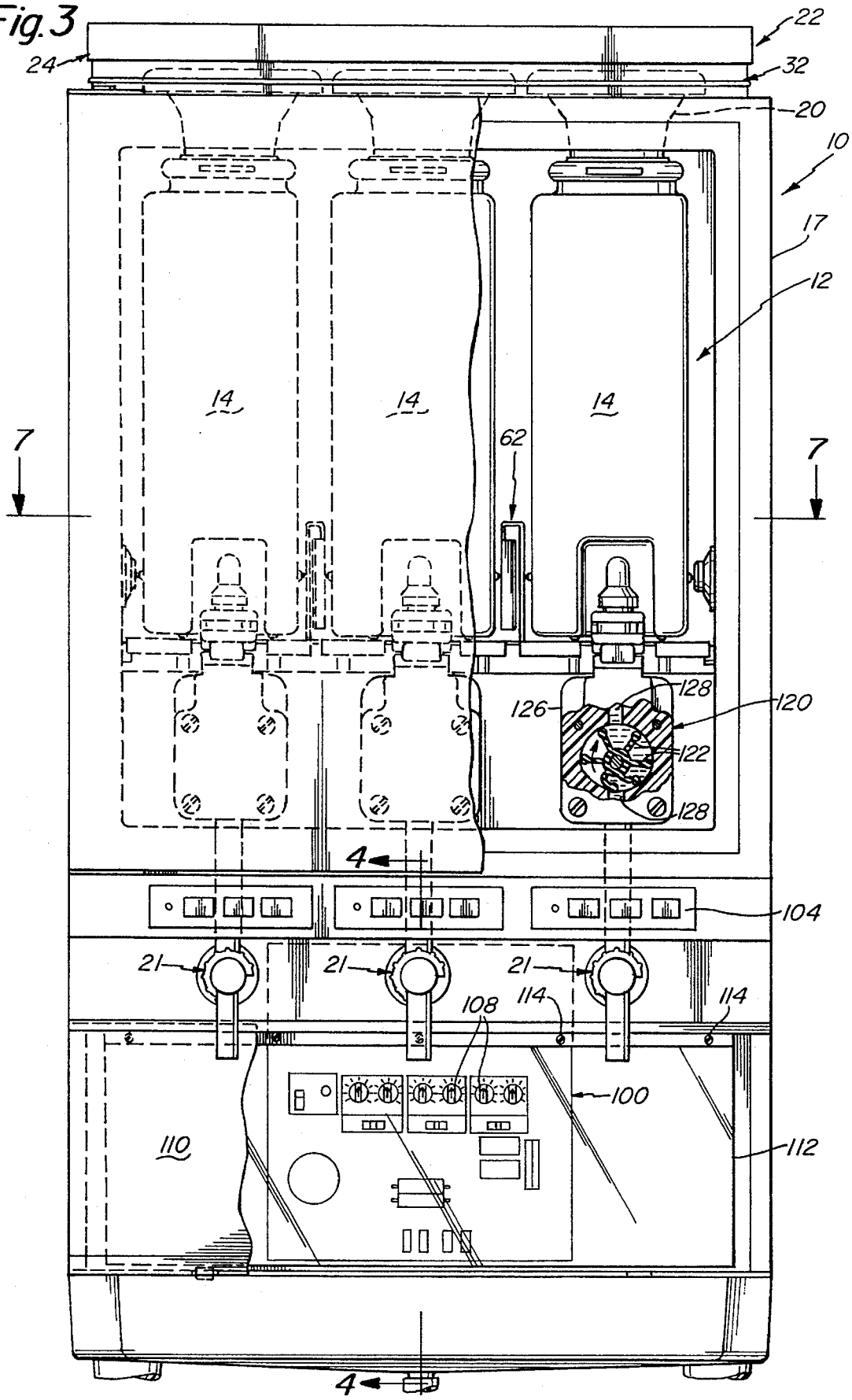
FIG. 3 is a partially broken away front view of the dispenser of FIG. 1.
Figure 4:
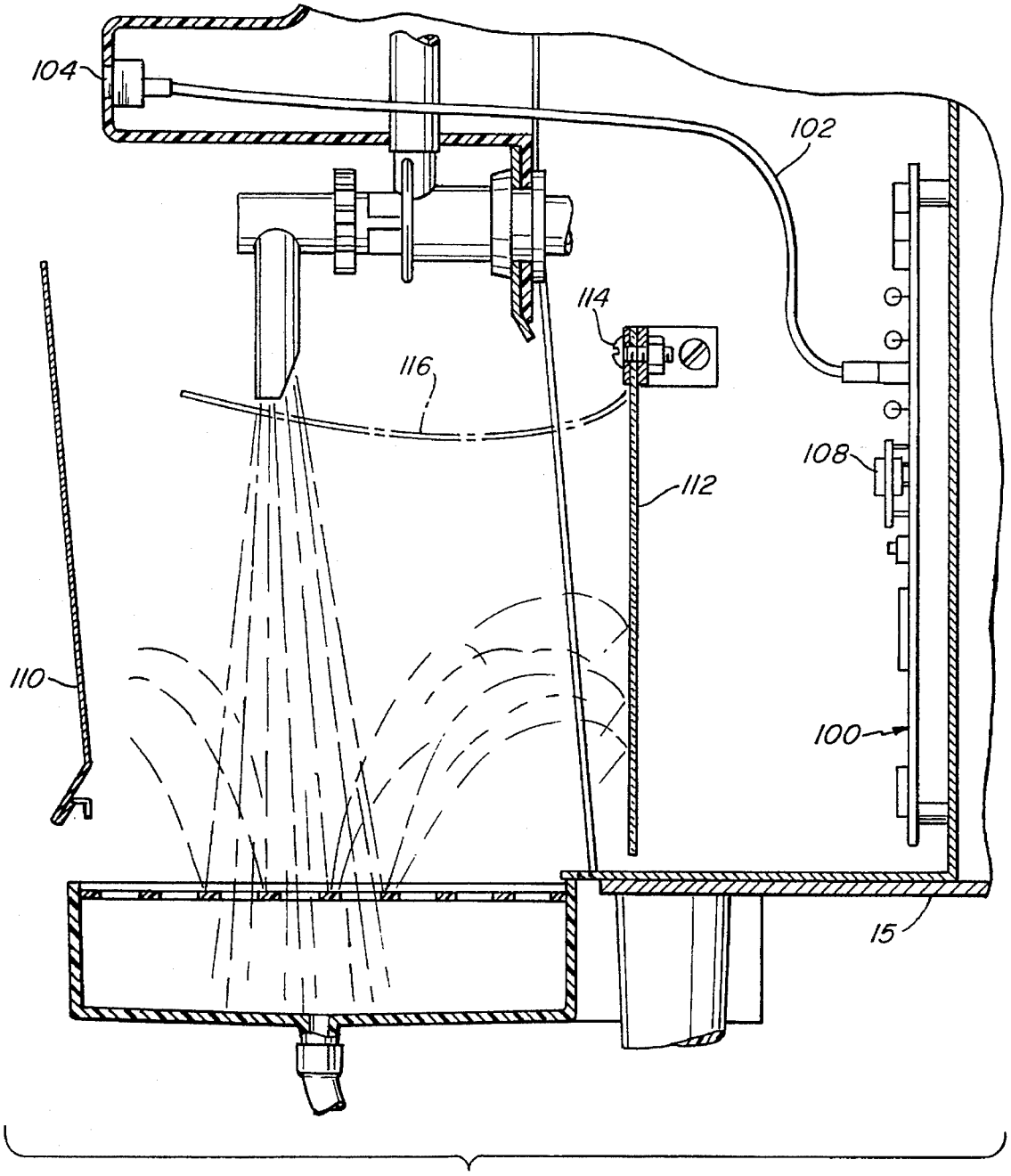
FIG. 4 is an exploded partial cross-sectional view taken along the line 4—4 of FIG. 3.

Access to system controls is provided as illustrated in FIGS. 2–4. The controls are controlled by a microprocessor on a circuit board 100. The circuit board is connected, through cable 102, to controls 104 which are visible to a user on the front of the dispenser (FIG. 1). Controls 104 allow a user to select a large size drink, small size drink, or continuous monitored flow. In addition, the circuitry on the circuit board 100 has a learning mode in which a user can set any level for a small glass or a large glass. A user positions a glass and fills it to a desired level. This level is entered as a particular size, and is provided whenever the particular size is selected.

Some of the controls are programmable and controllable on the exterior of the cabinet, but other controls, such as potentiometers 108, can be adjusted on the circuit board by a user. Potentiometers 108 can be adjusted for each spout to change the ratio of the water to syrup mixture. A removable splash plate cover 110 protects the circuitry during normal operation. When desired, however, plate 110 can be removed and the circuitry can be observed through a clear plastic shield 112. This shield is positioned vertically and is coupled to the frame of the cabinet with screws 114 across the top of the shield. This arrangement allows a user to easily lift the shield to a raised position 116 (FIG. 4). The shield allows a user to observe the circuit board during diagnostics, while still providing protection from liquid to the interior of the dispenser.

Referring to FIG. 2, a pump 120 is provided for each container, and has blades 122 which are turned by motor 124. The blades turn in housing 126 which also has conduits 128 with syrup. While motor 124 is outside the refrigerated compartment, according to the present invention, housing 126 of the pump with blades 122 are provided in a dropped portion in the refrigerated compartment. Thus the syrup which is in the pump is kept refrigerated. If the pump is not operated for a long period of time, the syrup in conduits 128 remains cool.

Figure 11:
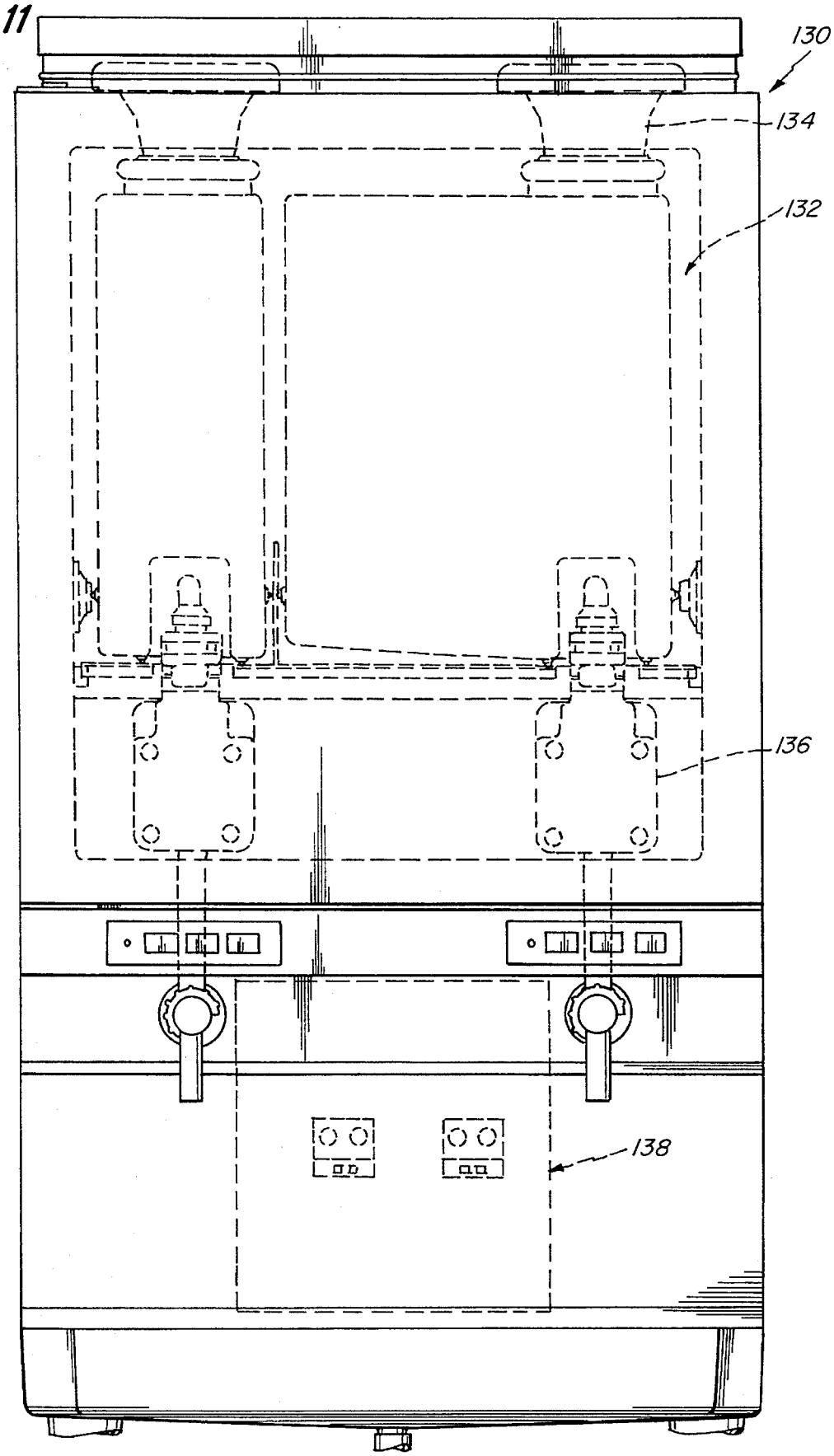
FIG. 11 is a front view of the beverage dispenser according to an alternative embodiment.

Referring to FIG. 11, the refrigerated compartment can hold two containers with different sizes. In this embodiment, funnels 134, the arrangement of pumps 136, and the shield 138 are similar to those described in the previous embodiment. The tray assembly is different because of the two containers.

The tray assembly may be similar if desired, and if there are three containers, including one which is different from the others, the tray assembly according to the present invention may be used.

Having described embodiments of the present invention, it should become apparent that other changes and modifications may be made without departing from the scope of the invention as defined by the appended claims.

What is claimed is:

1. A beverage dispenser having a refrigerated compartment for holding more than two containers for holding syrup, each container having a plurality of electrodes, the dispenser comprising:

a first horizontal tray for supporting a first container;

a second horizontal tray for supporting a second container, wherein the first and second trays are electrically insulated from each other, the second container having a first electrode for contacting the first tray and a second electrode for contacting the second tray; and a lead for providing an electrical signal to one of the first and second electrodes, wherein a conductive path is formed between the first and second electrodes when the syrup is at least at a certain level.

2. The dispenser of claim 1, wherein each container has a bottom portion and side portions, wherein the first electrode is in one of the side portions and the second electrode is in the bottom portion.

3. The dispenser of claim 2, wherein the first tray includes an integral vertical portion extending intermediate the first and second containers, and for contacting electrodes of each of the first and second containers.

4. A beverage dispenser having a refrigerated compartment for holding at least first and second containers for holding syrup, each of the containers having at least first and second electrodes, the dispenser comprising:

a first tray for supporting a first container, the first tray being electrically coupled to the first electrode of the first container;

a second tray for supporting a second container, wherein the first and second portions are electrically insulated from each other, the second tray being electrically coupled to the first electrode of the second container;

a first lead electrically coupled to the first tray; and a second lead electrically coupled to the second tray, wherein the first and second leads carry signals along conductive paths between the respective first and second electrodes that determine a level of syrup in the first and second containers.

5. The beverage dispenser of claim 4, further comprising a third lead electrically coupled to the second electrode of the second container, the first and third leads providing a conductive path that indicates a level of syrup in the first container.

6. The beverage dispenser of claim 5, wherein the first tray has a member for contacting the second electrode of the second container.

7. The beverage dispenser of claim 6, wherein the member for contacting the second electrode of the second container is generally vertical and intermediate the first and second containers.

8. The beverage dispenser of claim 4, wherein the dispenser holds a third container having first and second electrodes, the dispenser including a support member for contacting the first electrode of the third container.

9. The beverage dispenser of claim 8, wherein the support member is a portion of the first tray.

10. The beverage dispenser of claim 9, wherein the first tray surrounds three sides of the second tray.

11. The beverage dispenser of claim 9, wherein the first tray is shaped to contact the first electrodes of the first and third containers and the second electrode of the second container.

12. The beverage dispenser of claim 11, wherein the first tray includes first and second integral vertical portions extending upward, the first portion for extending between the first and second containers and the second portion for extending between the second and third containers.

13. The beverage dispenser of claim 11, further comprising a third lead coupled to the second electrode of the third container and a fourth lead coupled to the second electrode of the first container, wherein, if the syrup in each container exceeds a certain level, first lead and the fourth lead form a first conductive path through the first container, the first lead and the second lead form a second conductive path through the second container, and the first lead and the third lead form a third conductive path through the third container.

14. The beverage dispenser of claim 13, wherein the first tray is electrically grounded.

15. A beverage dispenser having a refrigerated compartment for holding adjacent first, second, and third containers for holding syrup, each of the containers having at least first and second electrodes, the dispenser comprising:

a frame;

a first electrically conductive horizontal member mounted to the frame for supporting the first container and for contacting the first electrode of the first container;

a second electrically conductive horizontal member mounted to the frame for supporting the second container and for contacting the first electrode of the second container;

a third electrically conductive horizontal member mounted to the frame for supporting the third container and for contacting the first electrode of the third container;

a first conductor electrically coupled to the first tray;

a second conductor electrically coupled to the second tray;

a third conductor electrically coupled to the second electrode of the first container;

a fourth conductor electrically coupled to the second electrode of the second container;

wherein the first and third conductors and the second and fourth conductors carry signals along first and second conductive paths between the respective first and second electrodes in the first and second containers to determine a level of syrup in the first and second containers.

16. The beverage dispenser of claim 15, wherein the fourth conductive member is integral with the first horizontal member and is grounded.

17. The beverage dispenser of claim 15, wherein the fourth conductor includes a generally vertical member intermediate the first and second containers.

18. The beverage dispenser of claim 15, further comprising a fifth conductor for contacting the second electrode of the third container, wherein the first electrode of the third container is electrically grounded.

19. The beverage dispenser of claim 15, wherein the first and third horizontal members are integral portions of a first tray.

20. The beverage dispenser of claim 19, wherein the fourth conductor is integrally formed with the first and third horizontal members, wherein the second horizontal member is intermediate and electrically insulated from the first and third horizontal members

* * * * *